US007401933B2

(12) United States Patent
Liang et al.

(10) Patent No.: US 7,401,933 B2
(45) Date of Patent: Jul. 22, 2008

(54) MOUNTING APPARATUS FOR LIGHT EMITTING DIODE

(75) Inventors: Chun-Chi Liang, Tu-cheng (TW); Ji-Guo Xu, Shenzhen (CN); Hsuan-Tsung Chen, Tu-cheng (TW)

(73) Assignees: Hong Fu Jin Precision Industry (Shenzhen) Co., Ltd., Bao-an District, Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 202 days.

(21) Appl. No.: 11/377,143

(22) Filed: Mar. 16, 2006

(65) Prior Publication Data

US 2006/0262546 A1 Nov. 23, 2006

(30) Foreign Application Priority Data

May 17, 2005 (CN) ..... 2005 2 0058628

(51) Int. Cl.
*F21V 33/00* (2006.01)

(52) U.S. Cl. ..... 362/85; 362/471; 362/489; 362/800; 248/27.1; 340/815.45; 361/806; 361/807

(58) Field of Classification Search ..... 248/27.1, 248/27.3; 361/806, 807; 340/815.45; 362/471, 362/489, 85, 545, 646, 652, 800
See application file for complete search history.

(56) References Cited

U.S. PATENT DOCUMENTS

| | | | | |
|---|---|---|---|---|
| 3,488,628 | A | 1/1970 | Lundergan et al. | |
| 4,667,270 | A | 5/1987 | Yagi | |
| 5,138,527 | A | 8/1992 | Jones | |
| 5,604,661 | A * | 2/1997 | Nagao | 248/27.3 |
| 6,275,387 | B1 | 8/2001 | Liao et al. | |
| 6,360,999 | B1 | 3/2002 | Liao | |

* cited by examiner

*Primary Examiner*—Stephen F. Husar
(74) *Attorney, Agent, or Firm*—Morris Manning Martin LLP; Tim Tingkang Xia, Esq.

(57) ABSTRACT

A mounting apparatus for a light emitting diode having a shoulder extending therefrom includes a panel, a base, and a bracket. The panel defines a through hole therein for the light emitting diode emitting light therethrough. The base extends from the panel round the through hole of the panel. The base includes a hollow cylinder. The cylinder defines a pair of mounting slots therein. The bracket includes a hollow retaining body for holding the light emitting diode therein. A pair of hooks and a pair of location portions extends from the retaining body. A height of the hooks is greater than that of the location portions. The shoulder of the light emitting diode is located between the hooks and location portions. A pair of shafts extends from the retaining body for being engaged in said mounting slots of the base.

20 Claims, 4 Drawing Sheets

MOUNTING APPARATUS FOR LIGHT EMITTING DIODE

BACKGROUND

1. Field of the Invention

The present invention relates to mounting apparatuses, and particularly to a mounting apparatus readily and securely installing or removing a light emitting diode thereto or therefrom.

2. General Background

Light emitting diodes are mounted to a computer system and are used to indicate the operational mode of the computer system by the light emitting therefrom. The light emitting diodes are usually mounted to a front panel of a computer enclosure of the computer system.

Traditionally, a light emitting diode is mounted to the front panel by glue. However, the light emitting diode is easily unglued for some time. Thus, the light emitting diode is separated from the front panel to effect indication.

What is needed is to provide a mounting apparatus which overcomes the above-mentioned problems.

SUMMARY

An exemplary mounting apparatus for a light emitting diode that has a shoulder extending therefrom includes a panel, a base, and a bracket. The panel defines a through hole therein for the light emitting diode emitting light therethrough. The base extends from the panel round the through hole of the panel. The base includes a hollow cylinder. The cylinder defines at least a mounting slot therein. The bracket includes a hollow retaining body for holding the light emitting diode therein. At least a hook and at least a location portion extend from the retaining body. A height of said hook is greater than that of said location portion. The shoulder of the light emitting diode is located between said hook and location portion. At least a shaft extends from the retaining body for being engaged in said mounting slot of the base.

Other advantages and novel features of the invention will become more apparent from the following detailed description when taken in conjunction with the accompanying drawings, in which:

DETAILED DESCRIPTION OF THE EMBODIMENT

Figure 1:
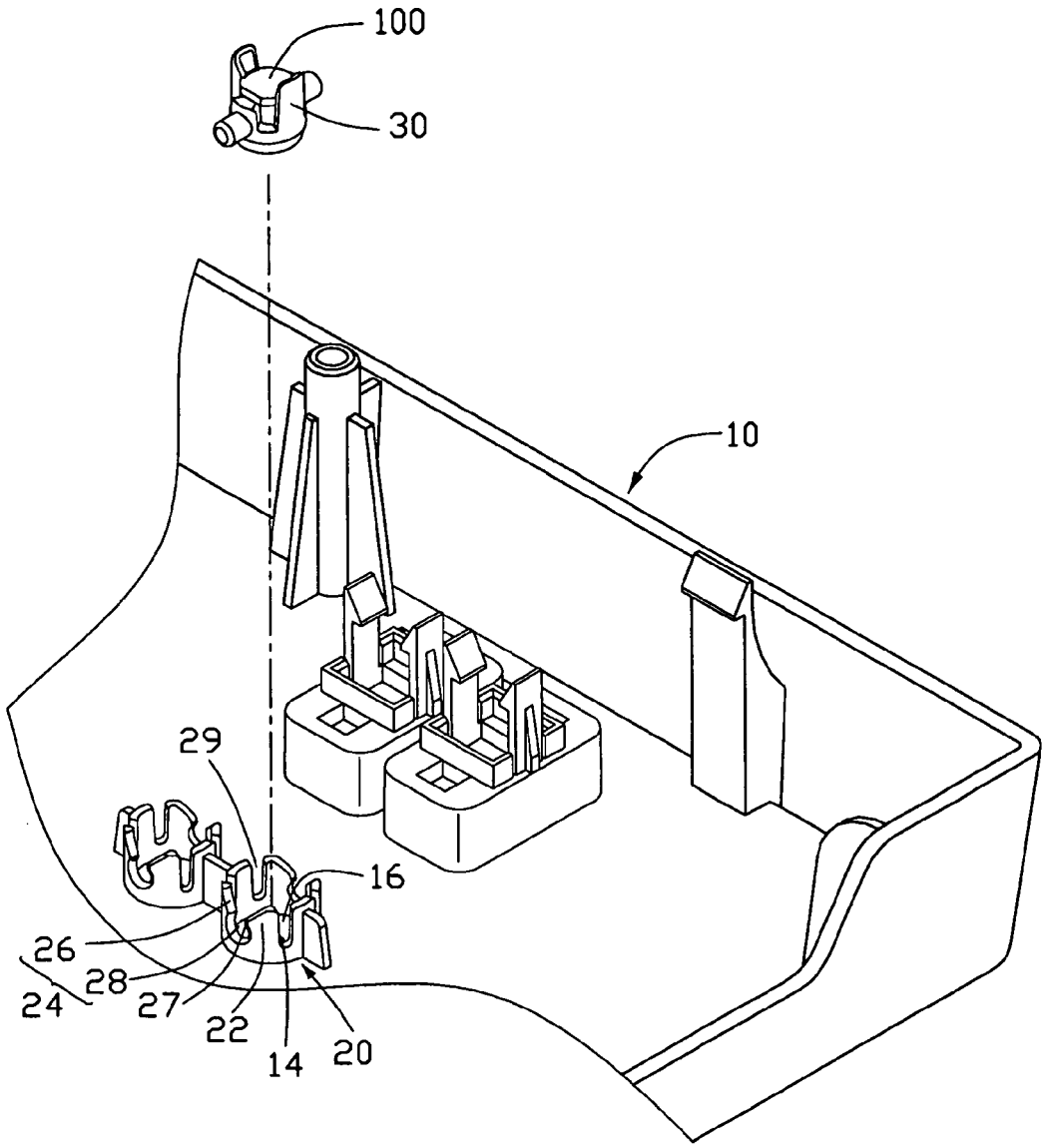
FIG. 1 is an exploded, isometric view of a mounting apparatus for light emitting diodes in accordance with a preferred embodiment of the present invention, together with a light emitting diode, the mounting apparatus includes a front panel, a base and a bracket.
Figure 2:
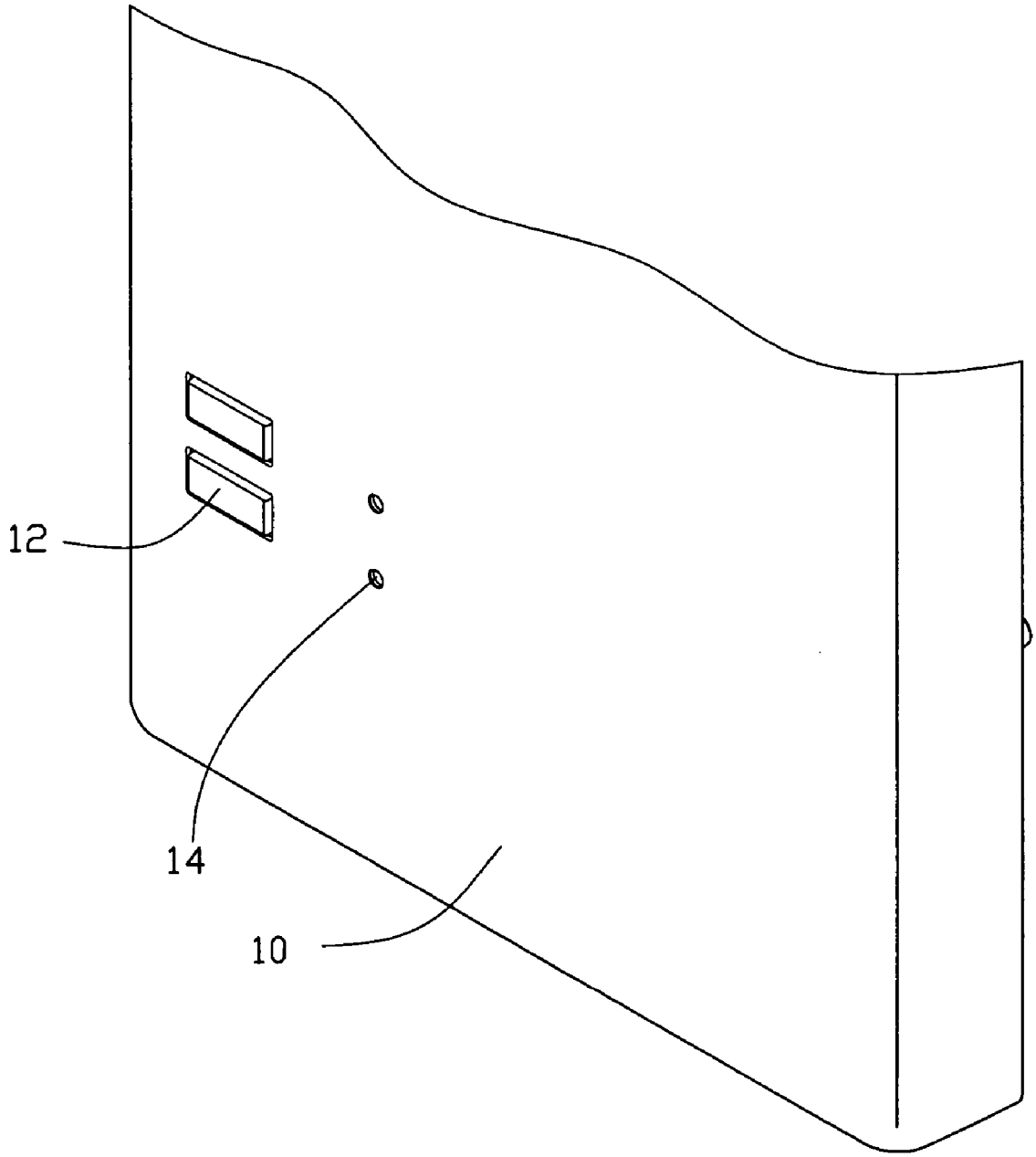
FIG. 2 is an isometric view of the front panel of FIG. 1, but viewed from another aspect.
Figure 3:
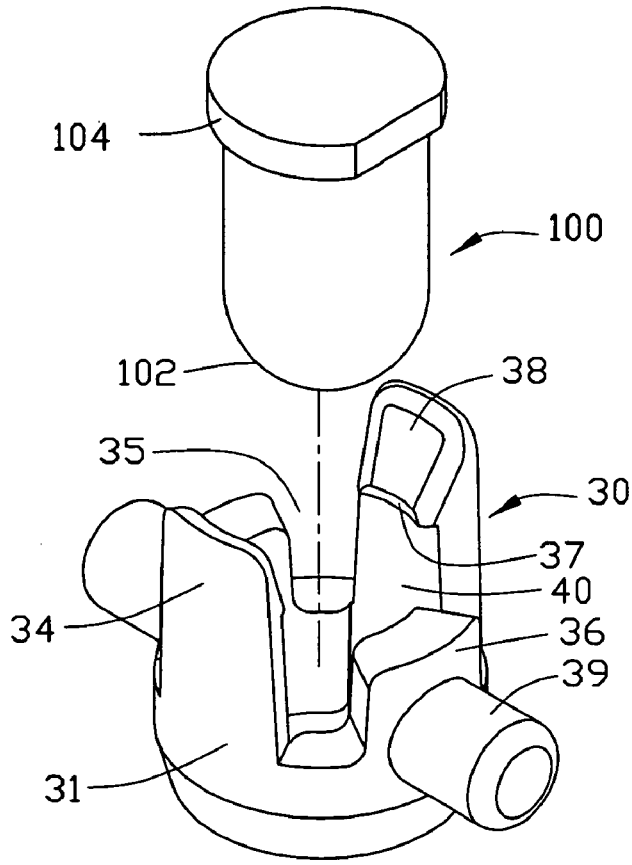
FIG. 3 is an exploded, isometric view of the bracket and the light emitting diode of FIG. 1.

Referring to FIGS. 1 to 3, a mounting apparatus in accordance with a preferred embodiment of the present invention is shown for mounting an indicator like a light emitting diode 100. The light emitting diode 100 includes a pillar body 101, and a shoulder 104 extending outwardly from a circumference of one end of the pillar body 101. The other end of the pillar body 101 forms a hemisphere 102. The mounting apparatus includes a front panel 10, a base extending inwardly from the front panel 20, and a bracket 30.

The front panel 10 defines a through hole 14 therein adjacent a corresponding button 12 for the light emitting diode 100 emitting light therethrough. A hemisphere dent 16 is defined in an inner surface of the front panel 10 round the through hole 14. The base 20 includes a hollow cylinder 22 extends inwardly from the front panel 10 round sides of the dent 16. A pair of mounting slots 24 is defined in the cylinder 22 at opposite sides. Each mounting slot 24 includes a V-shaped guiding slot 26 that is defined in a distal end of the cylinder 22, a superior arc receiving slot 28 that is defined in the cylinder 22 between the guiding slot 26 and the front panel 10. The receiving slot 28 is connected with the guiding slot 26. A pair of protrusions 27 protrudes from the cylinder 22 into the mounting slot 24 between the guiding slot 26 and the receiving slot 28. A plurality of cutouts 29 alternative with the mounting slots 24 is defined in the cylinder 22 at the distal end.

The bracket 30 includes a hollow retaining body 31. Four notches 35 are defined in sides of one end of the retaining body 31. Thus, a pair of L-shaped hooks 34 opposite to each other and a pair of location portions 36 opposite to each other is formed along the sides of the retaining body 31. The hooks 34 are alternative with the location portions 36. A height of each hook 34 is greater than that of a corresponding location portion 36. A chamfer angle surface 32 (shown in FIG. 4) is formed at the other end of the retaining body 31. Each hook 34 includes a slanting guiding surface 38 extending inwardly from a distal end thereof toward the end having the chamfer angle surface 32 of the retaining body 31. A blocking portion 37 is formed at a bottom of the guiding surface 38. A shaft 39 extends outwardly and perpendicularly from each location portion 36, respectively. A pair of avoiding slot 40 is defined in the hooks 34 from the blocking portion 37 to the end having the chamfer angle surface 32 of the retaining body 31.

Figure 4:
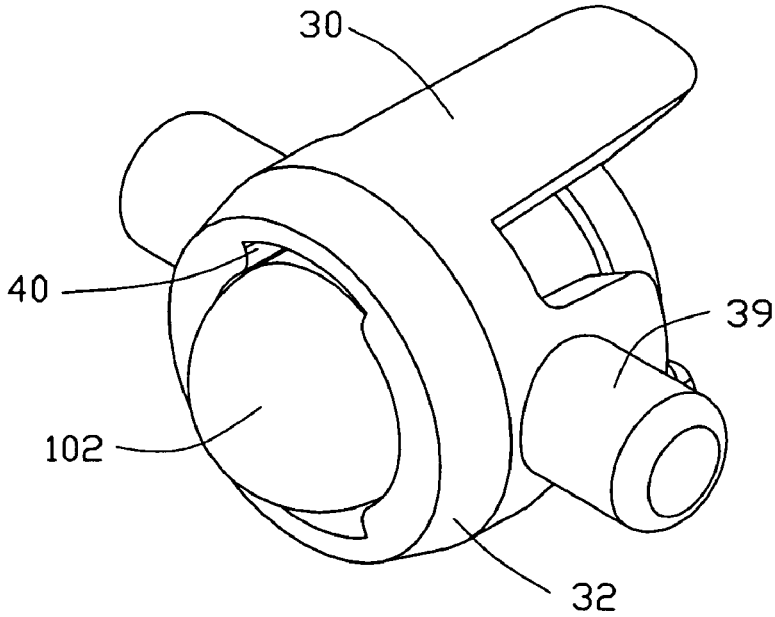
FIG. 4 is an assembled view of FIG. 3, but viewed from another aspect.

Referring also to FIG. 4, in assembling the light emitting diode 100 to the bracket 30, the light emitting diode 100 is put into the retaining body 31 of the bracket 30. The shoulder 104 of the light emitting diode 100 is sliding downwardly on the guiding surface 38 of the bracket 30, till the shoulder 104 is received in the avoiding slot 40 ofthe bracket 30. Thus, the shoulder 104 is located between the blocking portions 37 of the hooks 34 and the location portions 36 of the bracket 30. The hemisphere 102 of the light emitting diode 100 is exposed through the end having the chamfer angle surface 32 of the bracket 30.

Figure 5:
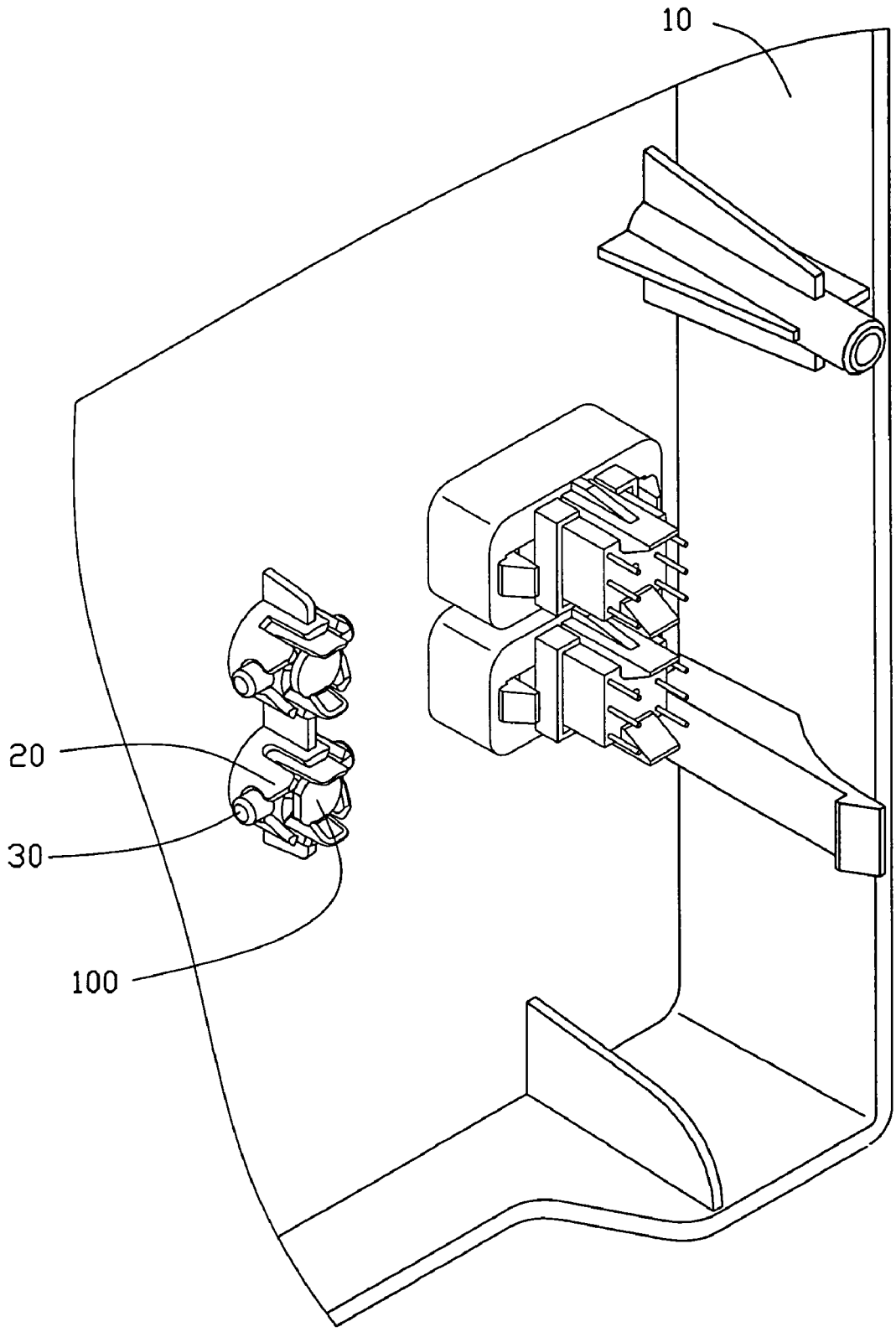
FIG. 5 is an assembled view of FIG. 1, but viewed from another aspect.

Referring also to FIG 5, in assembly, the combined light emitting diode 100 and bracket 30 is put into the base 20. The shafts 39 are squeezed to slide downwardly in the guiding slots 26. When the shafts 39 move to the protrusions 27, the shafts 39 drive the cylinder 22 between the mounting slots 24 and the corresponding cutouts 29 to twist toward the corresponding cutouts 29. Thus, the shafts 39 can slide into the corresponding receiving slots 28. The protrusions 27 can prevent the shafts 39 from being disengaged from the corresponding receiving slots 28. The chamfer angle surface 32 of the bracket and the hemisphere 102 of the light emitting diode 100 are received in the dent 16 of the front panel 10. The light emitting diode 100 can emit light through the through hole 14 of the front panel 10.

Furthermore, the location portions 36 can be formed on an inner surface of the hooks 34 and located under the blocking portions 37.

It is believed that the present embodiments and their advantages will be understood from the foregoing description, and it will be apparent that various changes may be made thereto without departing from the spirit and scope of the invention or sacrificing all of their material advantages, the examples hereinbefore described merely being preferred or exemplary embodiments of the invention.

We claim:

1. A mounting apparatus for a light emitting diode having a shoulder extending therefrom, comprising:

a panel defining a through hole therein for the light emitting diode emitting light therethrough;

a base extending from the panel round the through hole of the panel, the base comprising a hollow cylinder, the cylinder defining at least a mounting slot therein; and a bracket comprising a hollow retaining body for holding the light emitting diode therein, at least a hook and at least a location portion extending from the retaining body, a height of said hook being greater than that of said location portion, the shoulder of the light emitting diode being located between said hook and location portion, at least a shaft extending from the retaining body for being engaged in said mounting slot of the base.

2. The mounting apparatus as claimed in claim 1, wherein the light emitting diode comprises a hemisphere at one end, a hemisphere dent is defined in an inner surface of the panel round the through hole for receiving the hemisphere of the light emitting diode.

3. The mounting apparatus as claimed in claim 1, wherein said mounting slot comprises a pair of slots defined in the cylinder of the base, and said shaft comprises a pair of shafts extending outwardly and perpendicularly from the retaining body.

4. The mounting apparatus as claimed in claim 3, wherein each of the slots comprises a guiding slot that is defined in a distal end of the cylinder, and a receiving slot that is defined in the cylinder and between the guiding slot and the panel.

5. The mounting apparatus as claimed in claim 4, wherein the shafts are squeezed into the receiving slots of the slots.

6. The mounting apparatus as claimed in claim 5, wherein a pair of protrusions protrudes from the cylinder into each of the slots between the corresponding guiding slot and receiving slot.

7. The mounting apparatus as claimed in claim 3, wherein a pair of cutouts is defined in the cylinder of the base at the distal end, alternative with the slots.

8. The mounting apparatus as claimed in claim 3, wherein four notches are defined in one end of the retaining body of the bracket, said hook comprises a pair of hooks, and said location portion comprises a pair of location portions alternative with the hooks.

9. The mounting apparatus as claimed in claim 8, wherein each of the hooks comprises a slanting guiding surface extending from a distal end thereof, a blocking portion is formed at a bottom of the guiding surface.

10. The mounting apparatus as claimed in claim 9, wherein an avoiding slot is defined in an inner surface of each of the hooks, for receiving the shoulder of the light emitting diode.

11. A mounting apparatus for a light emitting diode comprising:

a panel defining a through hole therein for the light emitting diode emitting light therethrough;

a hollow base extending from the panel round the through hole of the panel, the base defining a pair of mounting slots therein; and a hollow bracket for holding the light emitting diode comprising a pair of shafts extending therefrom for being received in the mounting slots of the base.

12. The mounting apparatus as claimed in claim 11, wherein the light emitting diode comprises a hemisphere at one end, and a shoulder extending from an opposite end, a hemisphere dent is defined in an inner surface of the panel round the through hole for receiving the hemisphere of the light emitting diode.

13. The mounting apparatus as claimed in claim 12, wherein each of the mounting slots comprises a guiding slot that is defined in a distal end of the cylinder, and a receiving slot that is defined in the cylinder and between the guiding slot and the panel, the shafts are squeezed into the receiving slots.

14. The mounting apparatus as claimed in claim 12, wherein a pair of protrusions protrudes from the cylinder into each of the mounting slots between the corresponding guiding slot and receiving slot.

15. The mounting apparatus as claimed in claim 14, wherein four notches are defined in one end of the retaining body of the bracket, a pair of hooks is alternative with a pair of location portions by the notches.

16. The electronic device as claimed in claim 15, wherein each of the hooks comprises a slanting guiding surface extending from a distal end thereof, a blocking portion is formed at a bottom of the guiding surface.

17. The mounting apparatus as claimed in claim 16, wherein an avoiding slot is defined in an inner surface of each of the hooks, for receiving the shoulder of the light emitting diode.

18. The mounting apparatus as claimed in claim 17, wherein a height of the hooks is greater than that of the location portions, the shoulder of the light emitting diode is located between the hooks and the location portions.

19. An electronic device comprising:

a panel of said electronic device shielding a side of said electronic device, said panel defining a through hole therein, a base extending from said panel into said electronic device around said through hole;

an indicator removably installable in said through hole and said base of said panel so as to be viewable outside said panel of said electronic device; and a discretely-formed bracket adapted to securely receive said indicator therein, and to enable mechanical engagement with said base of said panel for said indicator in order to retainably install said indicator in said through hole of said panel;

wherein a pair of shafts extends away from said bracket along two opposite directions respectively so as to perform said mechanical engagement with said base of said panel.

20. The electronic device as claimed in claim 19, wherein said base comprises a hollow cylinder, said cylinder defines at least one mounting slot corresponding to said pair of shafts of said bracket for said mechanical engagement.

* * * * *